US008529213B2

(12) United States Patent
Yao

(10) Patent No.: US 8,529,213 B2
(45) Date of Patent: Sep. 10, 2013

(54) STRUCTURE OF DECORATING SHELL FOR CEILING FAN

(76) Inventor: Chao-chin Yao, Taichung (TW)

( * ) Notice: Subject to any disclaimer, the term of this patent is extended or adjusted under 35 U.S.C. 154(b) by 791 days.

(21) Appl. No.: 12/778,139

(22) Filed: May 12, 2010

(65) Prior Publication Data

US 2011/0280733 A1 Nov. 17, 2011

(51) Int. Cl.
*B63H 1/28* (2006.01)

(52) U.S. Cl.
USPC ..... 416/244 R

(58) Field of Classification Search
USPC ..... 416/5, 71, 72, 70 A, 244 R, 208, 416/209; 415/213.1, 214.1; D26/24, 72, D26/74
See application file for complete search history.

(56) References Cited

U.S. PATENT DOCUMENTS 8,033,787 B1 * 10/2011 Miller et al. ..... 416/5

* cited by examiner

*Primary Examiner* — Edward Look
*Assistant Examiner* — Juan G Flores
(74) *Attorney, Agent, or Firm* — Wang Law Firm, Inc.; Li K. Wang; Stephen Hsu

(57) ABSTRACT

A structure of the decorating shell for a ceiling fan includes an outer shell and a decorating cover. The bottom of the outer shell has a connecting hole. The surrounding surface at the bottom of the outer shell has at least two opposite grooves. The decorating cover has an annular shape and is correspondingly disposed at the bottom of the outer shell. The outer rim of the decorating cover is protruded upward with hook parts to engage with the grooves. At least one elastic body is interposed between the inner rim and the outer rim of the decorating cover. When the decorating cover is mounted onto the bottom of the outer shell, the elastic body is squeezed by the outer shell and the decorating cover to urge against the surrounding surface at the bottom of the outer shell.

3 Claims, 5 Drawing Sheets

STRUCTURE OF DECORATING SHELL FOR CEILING FAN

BACKGROUND OF THE INVENTION

1. Field of Invention

The invention relates to a structure of the outer shell of a ceiling fan and, in particular, to a decorating shell structure of a ceiling fan.

2. Related Art

As shown in FIG. 6, the decorating cover for the hanging bell of a conventional ceiling fan. The surrounding surface at the bottom of the hanging bell 61 is formed with several through holes 62. Several screws go through the through holes 62 to fix the hanging bell 61 under a hanging frame (not shown). Since the screws are exposed at the bottom of the hanging bell 61, it is customary to cover them with a decorating cover 63. The bottom of the hanging bell 61 converges downward to form a neck 64. The inner rim of the neck 64 is protruded toward its center with at least three urging parts 65. The inner rim of the decorating cover 63 is protruded upward with catching parts 66 corresponding to the urging parts 65. Each of the catching parts 66 is formed with a groove 67. Bumps 68 are formed at appropriate positions in the grooves 67. To assemble them, one only needs to align the urging parts 65 with the concave part between the catching parts, followed by rotating the decorating cover 63 so that the urging parts 65 pass the bumps 68 and fall into the grooves 67 of the catching parts 66. This completes the assembly.

The above-mentioned structure of decorating cover achieves the positioning effect by engaging the catching parts 66 of the decorating cover 63 with the urging parts 65 of the hanging bell 61. Therefore, after combining the decorating cover 63 and the hanging bell 61, it is likely to produce noises from the collisions between the catching parts 66 of the decorating cover 63 and the urging parts 65 of the hanging bell 61 when the ceiling fan is running. Moreover, the catching parts 66 and the urging parts 65 wear out each other, so that the decorating cover 63 in the end cannot be firmly fixed to the bottom of the hanging bell 61.

SUMMARY OF THE INVENTION

An objective of the invention is to provide a decorating shell structure of a ceiling fan, with the advantage of low cost and better assembly stability.

To achieve the above objective, the disclosed decorating shell structure of a ceiling fan has an outer shell and a decorating cover.

The top of the outer shell forms an open end to the environment. The bottom of the outer shell is formed with a connecting hole. The surrounding surface at the bottom of the outer shell is formed with at least two opposite grooves.

The decorating cover has an annular shape and is correspondingly disposed at the bottom of the outer shell. The inner rim of the decorating cover is protruded upward with a blocking ring urging the connecting hole at the bottom of the outer shell. The outer rim of the decorating cover is protruded upward with hook parts to engage with the grooves. At least one elastic body is interposed between the inner rim and the outer rim of the decorating cover. When the decorating cover is mounted onto the bottom of the outer shell, the elastic body is squeezed by the outer shell and the decorating cover to urge against the surrounding surface at the bottom of the outer shell.

BRIEF DESCRIPTION OF THE DRAWINGS

These and other features, aspects and advantages of the invention will become apparent by reference to the following description and accompanying drawings which are given by way of illustration only, and thus are not limitative of the invention, and wherein.

DETAILED DESCRIPTION OF THE INVENTION

The present invention will be apparent from the following detailed description, which proceeds with reference to the accompanying drawings, wherein the same references relate to the same elements.

Figure 1:
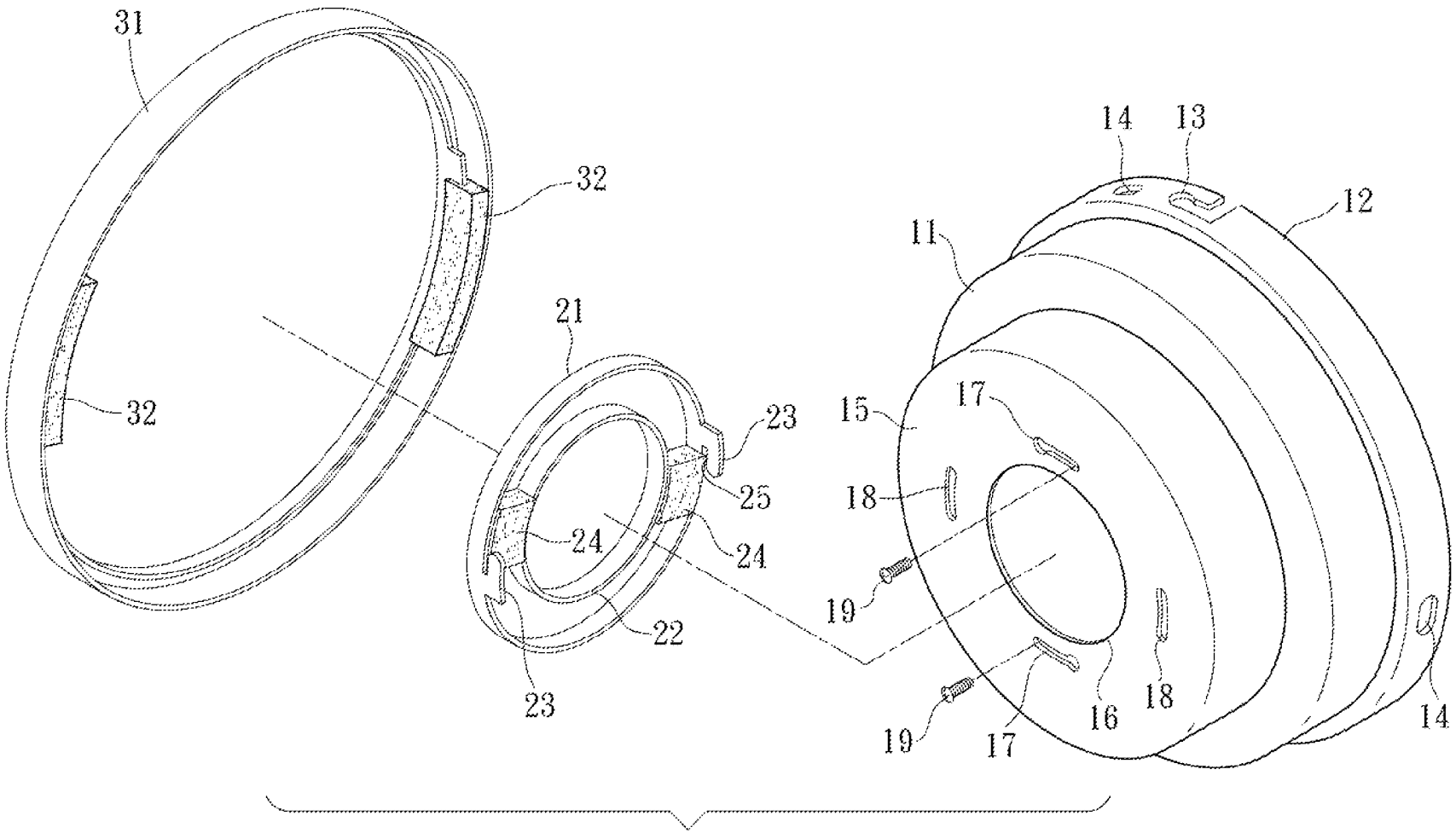
FIG. 1 is a three-dimensional exploded view of the invention.
Figure 2:
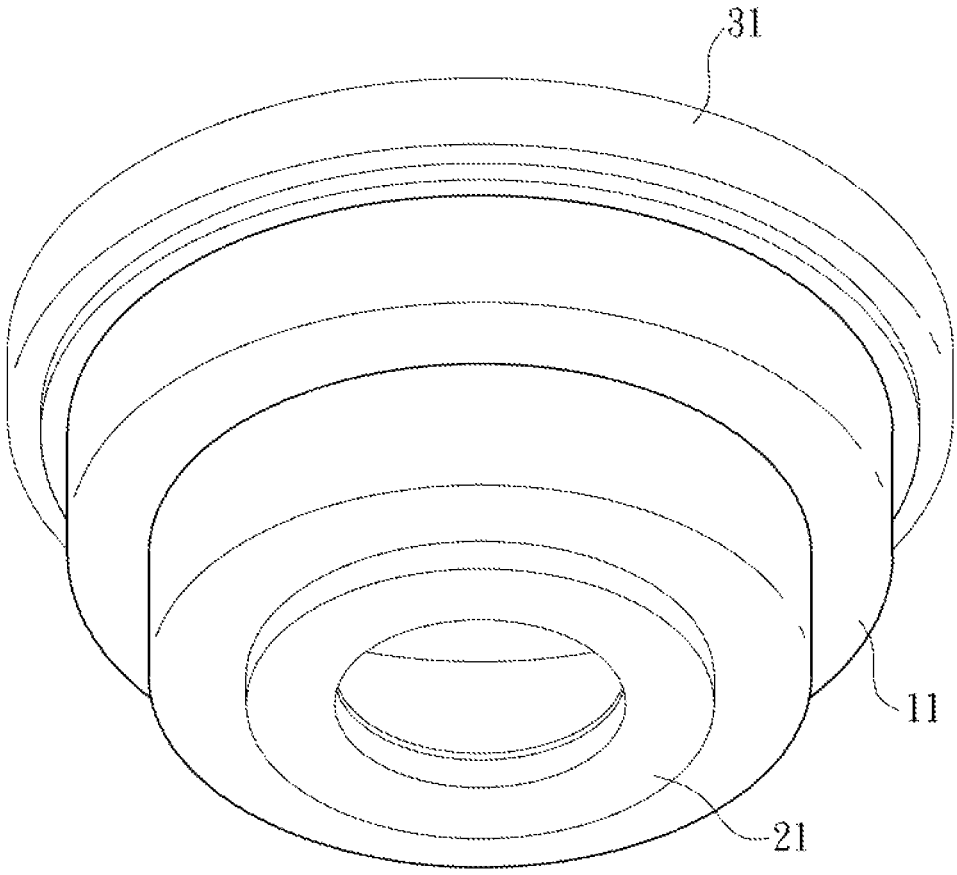
FIG. 2 is a three-dimensional perspective view of the invention after assembly.
Figure 3:
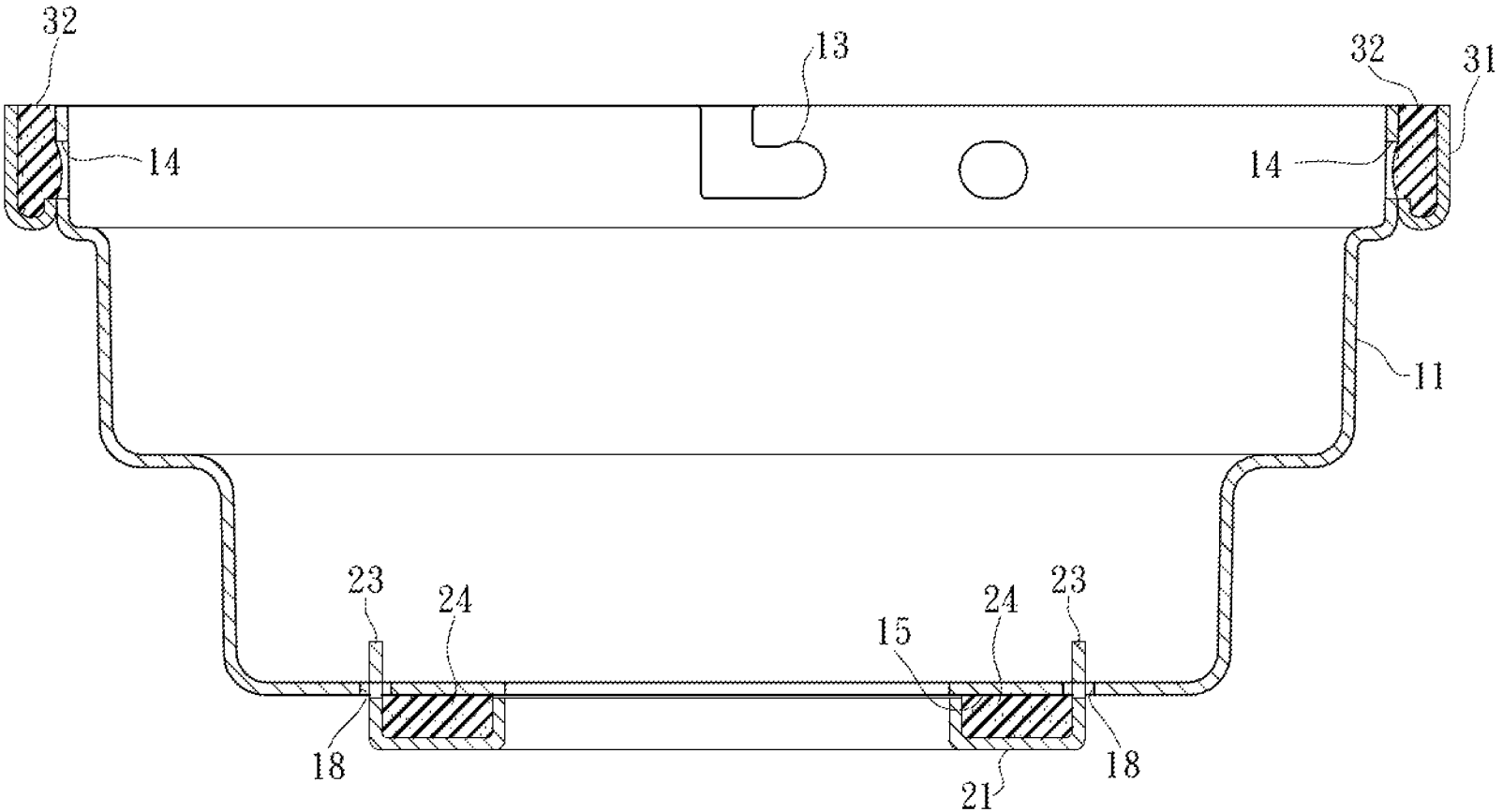
FIG. 3 is a cross-sectional view of the invention after assembly.

Please refer to FIGS. 1 to 3. The decorating shell structure for a ceiling fan disclosed herein includes: an outer shell 11, a decorating cover 21, and a decorating ring 31.

The top of the outer shell 11 forms an open end 12 to the environment, through which a fixing base (not shown) is to be accommodated in the outer shell 11. The surrounding sidewall of the open end 12 is formed with several through holes 13 and positioning holes 14 at a fixed interval. The bottom of the outer shell 11 is formed with a surrounding surface 15. The center of the surrounding surface 15 is formed with a connecting hole 16 in the axial direction. The surrounding surface 15 is further formed with two screw holes 17 and two grooves 18 around the connecting hole 16. Each of the screw holes 17 allows a screw element 19 to go through, thereby fixing the outer shell 11 to the fixing base.

The decorating cover 21 has an annular shape and is correspondingly disposed at the bottom of the outer shell 11 to cover the through holes 13. The inner rim of the decorating cover 21 is protruded upward with a blocking ring 22 corresponding to the connecting hole 16 at the bottom of the outer shell 11. The outer rim of the decorating cover 21 is protruded upward with two hook parts 23 corresponding to the two grooves 18 of the outer shell 11. The two hook parts 23 are plates extending in the horizontal direction. Two elastic bodies 24 are interposed between the inner rim and the outer rim of the decorating cover 21. The two elastic bodies 24 are on the sides of the two hook parts 23. The height of the top surface of the two elastic bodies 24 is slightly higher than that of the inner and outer rims of the decorating cover 21, so that engaging grooves are formed between the two hook parts 23 and the top surface of the elastic bodies to engage with the grooves 18 at the bottom of the outer shell 11. The decorating cover 21 uses the engaging grooves 25 formed between its hook parts 23 and the elastic bodies 24 to engage with the grooves 18 at the bottom of the outer shell 11. In this case, the elastic bodies 24 are squeezed by the outer shell 11 and the decorating cover 21 to urge against the surrounding surface 15 at the bottom of the outer shell 11.

The decorating ring 31 has an annular shape, with an inner diameter slightly larger than the outer diameter of the top of the outer shell 11. It can be mounted on the top portion of the outer shell 11 to cover the through holes 13 thereon. The inner rim of the decorating ring 31 has two second elastic bodies 32 corresponding to the positioning holes 14 of the outer shell 11. The inner diameter formed by the two second elastic bodies 32 is slightly smaller than the outer diameter of the open end 12 on top of the outer shell 11. The two second elastic bodies 32 can be depressed due to its elasticity, so that the decorating ring 31 can be smoothly mounted on the top portion of the outer shell 11. When the decorating ring 31 is mounted on the top portion of the outer shell 11, the second elastic bodies 32 urge against the positioning holes 14 in order to position the decorating ring 31.

Figure 4:
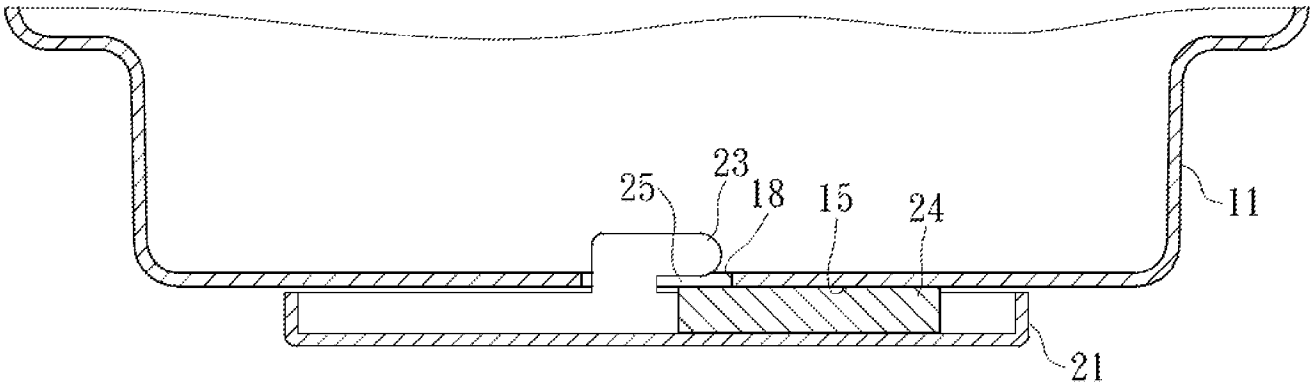
FIG. 4 schematically shows the invention in use, when the hook parts of the decorating cover are inserted into the grooves on the outer shell.
Figure 5:
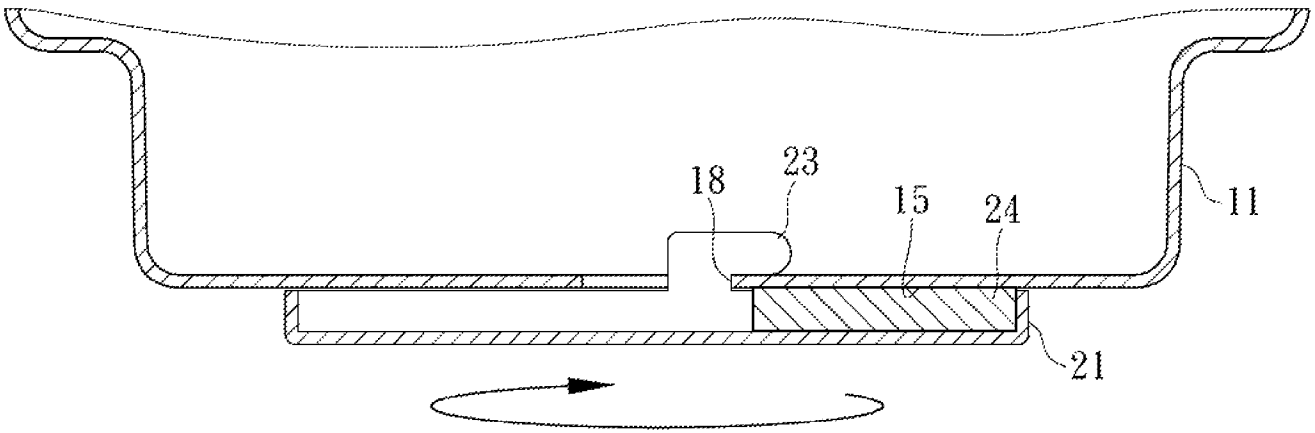
FIG. 5 schematically shows the invention in use, when the engaging groove formed between the hook parts and the elastic body engages with the grooves.
Figure 6:
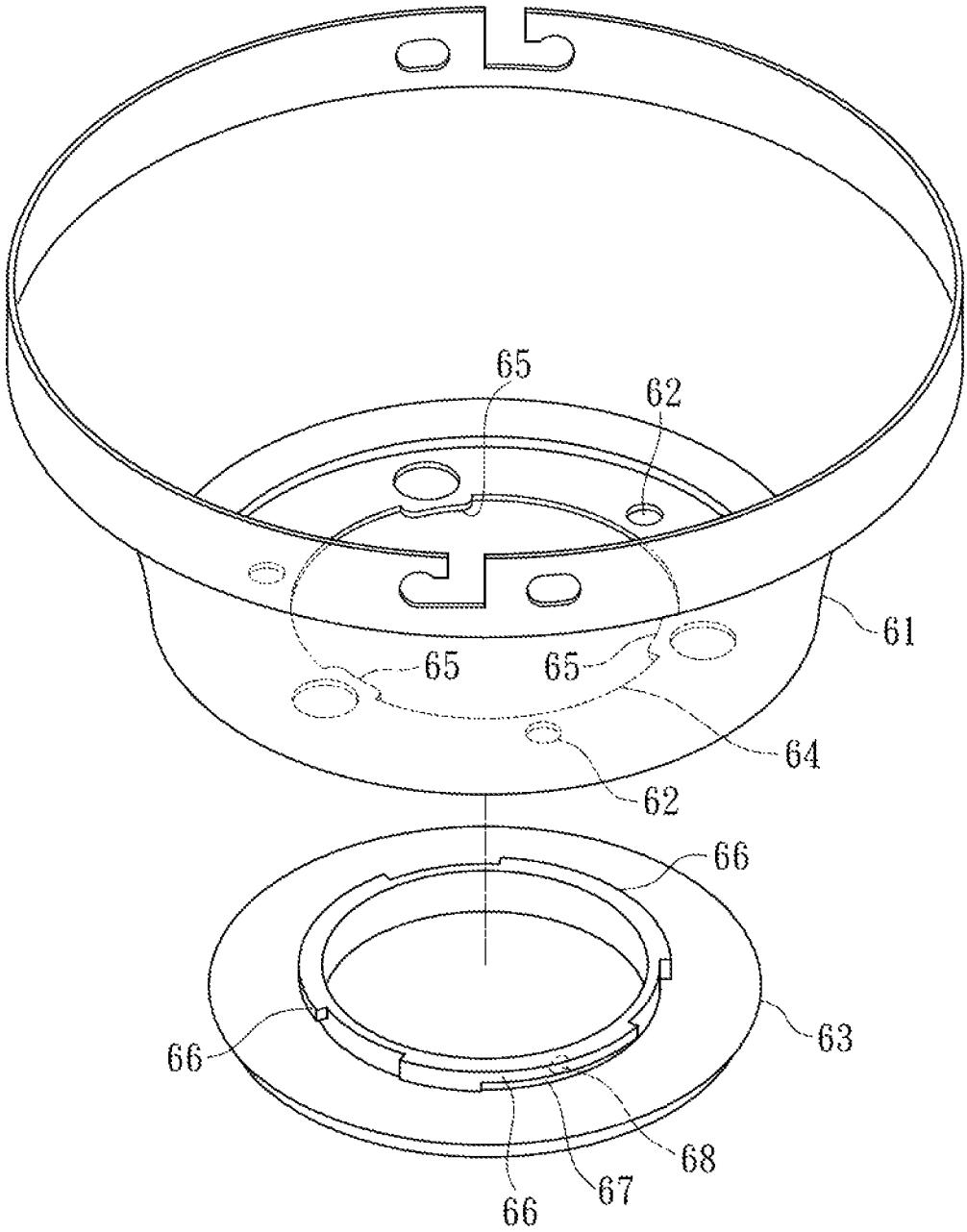
FIG. 6 PRIOR ART
FIG. 6 shows the decorating cover structure for the hanging bell of a ceiling fan in the prior art.

When the decorating cover 21 and the outer shell 11 are assembled, as shown in FIG. 4, the hook parts 23 of the decorating cover 21 are inserted into the grooves 18 of the outer shell 11. The elastic bodies 24 are depressed so that the elastic bodies 24 urge against the surrounding surface 15 on the bottom of the outer shell 11. Afterwards, the decorating cover 21 is turned, as shown in FIG. 5, so that the engaging grooves 25 formed between the hook parts 23 and the elastic bodies 24 engage with the grooves 18. The reaction generated by the depression of the elastic bodies 24 imposes an extra force on the decorating cover 21 and the outer shell 11. This effectively increases the stability of the assembled hook parts 23 and the grooves 18. Even if the hook parts 23 or the grooves 18 are worn out, the urging effect of the elastic bodies 24 still maintain the stability of the decorating cover 21 and outer shell 11.

The invention as described above has the following advantages:

1. One only needs to align and insert the hook parts 23 of the decorating cover 21 into the grooves 18 of the outer shell 11 and then turn the decorating cover 21 to accomplish a quick assembly. This is because the invention has a fairly simple structure and low production cost.

2. After the decorating cover 21 and the outer shell 11 are assembled, the elastic bodies 24 impose an extra urging force on the decorating cover 21 and the outer shell 11. This effectively increases the stability in the assembly between the decorating cover 21 and the outer shell 11. Even if the hook parts 23 or the grooves 18 are worn out, the urging effect of the elastic bodies 24 still maintain the stability of the decorating cover 21 and outer shell 11.

3. After the assembly of the decorating cover 21 and the outer shell 11 according to the invention, the elastic bodies 24 urge against the surrounding surface 15 on the bottom of the outer shell 11 to provide a cushion effect. This alleviates the collision between the decorating cover 21 and the outer shell 11 when the ceiling fan is running.

4. Using the decorating cover 21 and the decorating ring 31, the invention can cover the screw elements on the outer shell 11. The ceiling fan thus looks more beautiful.

Although the invention has been described with reference to specific embodiments, this description is not meant to be construed in a limiting sense. Various modifications of the disclosed embodiments, as well as alternative embodiments, will be apparent to people skilled in the art. Therefore, it is contemplated that the appended claims will cover all modifications that fall within the true scope of the invention.

What is claimed is:

1. A decorating shell structure of a ceiling fan, comprising:

an outer shell whose top forms an open end connecting to the environment and whose bottom is formed with a surrounding surface, the surrounding surface being formed with a connecting hole and at least two grooves annularly around the connecting hole;

a decorating cover having an annular shape and disposed on the bottom of the outer shell, with the inner rim thereof protruded upward with a blocking ring corresponding to the connecting hole on the bottom of the outer shell, the outer rim thereof protruded upward with two hook parts opposite to each other and corresponding to the grooves of the outer shell, and at least one elastic body interposed between the inner rim and the outer rim;

wherein the height of the top surface of the elastic bodies is slightly higher than the height of the inner and outer rims of the decorating cover; an engaging groove corresponding to the groove on the bottom of the outer shell is formed between each of the two hook parts and the top surface of the elastic bodies; the engaging grooves formed between the hook parts and the elastic bodies engage with the grooves on the bottom of the outer shell; and the top surface of the elastic bodies urge against the surrounding surface on the bottom of the outer shell.

2. A decorating shell structure of a ceiling fan as in claim 1, wherein the two hook parts are plates extending in the horizontal direction; two elastic bodies are interposed between the inner rim and the outer rim of the decorating cover; and the two elastic bodies are by the sides of the two hook parts.

3. A decorating shell structure of a ceiling fan as in claim 1, wherein the surrounding side wall of the open end of the outer shell is formed with a plurality of positioning holes at an interval; a decorating ring having an annular shape and an inner diameter slightly larger than the outer diameter of the top portion of the outer shell is mounted on the top portion of the outer shell; the inner rim of the decorating ring has at least one second elastic body corresponding to the positioning holes on the outer shell; the inner diameter formed by the second elastic bodies is slightly smaller than the outer diameter of the open end on the top of the outer shell; and the second elastic bodies are depressed to urge against the positioning holes when the decorating ring is mounted on the top portion of the outer shell.

* * * * *